US007665440B2

(12) United States Patent
Holtan et al.

(10) Patent No.: US 7,665,440 B2
(45) Date of Patent: Feb. 23, 2010

(54) CYLINDER LINERS AND METHODS FOR MAKING CYLINDER LINERS

(75) Inventors: Steven T. Holtan, Port Washington, WI (US); Shengli Liu, New Berlin, WI (US)

(73) Assignee: Slinger Manufacturing Company, Inc., Slinger, WI (US)

( * ) Notice: Subject to any disclaimer, the term of this patent is extended or adjusted under 35 U.S.C. 154(b) by 263 days.

(21) Appl. No.: 11/422,232

(22) Filed: Jun. 5, 2006

(65) Prior Publication Data

US 2007/0277771 A1 Dec. 6, 2007

(51) Int. Cl.
*F02F 1/00* (2006.01)

(52) U.S. Cl. ..... 123/193.2; 29/888.061

(58) Field of Classification Search ..... 123/193.2, 123/195 R; 29/888.061
See application file for complete search history.

(56) References Cited

U.S. PATENT DOCUMENTS 3,561,104 A 2/1971 Holtan et al.
3,657,078 A * 4/1972 Schweikher ..... 205/131
3,937,266 A 2/1976 Cordone et al.
4,706,417 A * 11/1987 Gary ..... 451/38
4,724,819 A * 2/1988 Fleri ..... 123/668
4,937,927 A 7/1990 Taipale
5,080,056 A 1/1992 Kramer et al.
5,183,025 A * 2/1993 Jorstad et al. ..... 123/669
5,311,652 A 5/1994 McConkey et al.
5,315,970 A * 5/1994 Rao et al. ..... 123/193.2
5,333,668 A 8/1994 Jorstad et al.
5,363,821 A * 11/1994 Rao et al. ..... 123/193.2
5,429,173 A 7/1995 Wang et al.
5,626,674 A 5/1997 VanKuiken, Jr. et al.
5,701,861 A * 12/1997 Hegemier et al. ..... 123/193.2
5,727,511 A * 3/1998 Omura et al. ..... 123/193.2
5,749,331 A * 5/1998 Pettersson et al. ..... 123/193.2
5,829,405 A * 11/1998 Godel ..... 123/193.2
6,074,763 A * 6/2000 Rueckert et al. ..... 428/577
6,286,583 B1 * 9/2001 Rueckert et al. ..... 164/100
6,354,259 B2 3/2002 Fischer et al.
6,468,673 B2 10/2002 Saito
6,519,848 B2 * 2/2003 Komazaki et al. ..... 29/888.061
6,640,765 B2 * 11/2003 Land et al. ..... 123/193.2
6,749,894 B2 6/2004 Subramanian et al.
6,863,931 B2 3/2005 Someno et al.

(Continued)

FOREIGN PATENT DOCUMENTS

JP 57142756 9/1982

(Continued)

*Primary Examiner*—Noah Kamen
(74) *Attorney, Agent, or Firm*—McNees Wallace & Nurick, LLC

(57) ABSTRACT

A method for making cylinder liners and cast engine blocks having cylinder liners having a strong mechanical bond with the engine block. The method includes providing a cast metallic cylinder liner having an outer surface of the cylinder liner. The surface of the cylinder liner is preferably machined to remove surface effects or defects present from the casting process. Grit particles are directed at the outer surface of the cylinder liner with a grit blasting device at a predetermined angle of contact at a sufficient velocity to form cavities on the outer surface. The cavities that are formed have a geometry capable of forming a mechanical bond with the casting material of the engine block.

18 Claims, 10 Drawing Sheets

U.S. PATENT DOCUMENTS

| | | | | |
|---|---|---|---|---|
| 6,865,807 | B2 * | 3/2005 | Miyamoto et al. | 29/888.061 |
| 7,073,492 | B2 * | 7/2006 | Hoffmann et al. | 123/669 |
| 2001/0003227 | A1 * | 6/2001 | Feikus | 29/888.06 |
| 2001/0037786 | A1 * | 11/2001 | Fischer et al. | 123/193.2 |
| 2003/0079852 | A1 * | 5/2003 | Rueckert et al. | 164/100 |
| 2005/0016489 | A1 * | 1/2005 | Endicott et al. | 123/193.2 |
| 2005/0061285 | A1 * | 3/2005 | Rueckert et al. | 123/193.2 |
| 2006/0032473 | A1 * | 2/2006 | Boehm et al. | 123/193.2 |

FOREIGN PATENT DOCUMENTS

| | | | |
|---|---|---|---|
| JP | 58211550 | A | 12/1983 |
| JP | 59054754 | | 3/1984 |
| JP | 59074353 | | 4/1984 |
| JP | 03238157 | A | 10/1991 |
| JP | 08174188 | | 7/1996 |
| JP | 2001353566 | | 12/2001 |
| JP | 2003260559 | | 9/2003 |
| JP | 2004209507 | | 7/2004 |
| JP | 2006043708 | A * | 2/2006 |

* cited by examiner

CYLINDER LINERS AND METHODS FOR MAKING CYLINDER LINERS

FIELD OF THE INVENTION

The present invention is directed to cast-in cylinder liners and engine blocks utilizing cast-in cylinder liners.

BACKGROUND OF THE INVENTION

Inner walls of the cylinder bores of internal combustion engines are subject to the wearing action of a piston and its seal structure. In engines fabricated from aluminum, aluminum alloys or other lightweight materials, cylinder liners are cast into the bores of the engine block to provide the necessary wear resistance. The casting of cast iron cylinder liners into aluminum blocks allows for excellent iron wearing surfaces in the bores of a lightweight fuel-efficient aluminum block engine.

One known process for inserting the cylinder liners into the engine block includes positioning the cylinder liner in the engine block mold prior to pouring molten metal into the mold cavity to form the engine block. After the casting is complete, these cast-in liners are permanently embedded within the cast metal walls of the cylinder bores.

Cylinder liners for use in the manufacture of engine blocks typically are manufactured using either conventional sand "static" casting or by centrifugal casting. While conventional sand casting incorporates insulating sand on the inside diameter and the outside diameter of the solidifying casting which helps to slow the solidification rate, the centrifugal casting technique does not have that advantage. Centrifugal casting uses a spinning permanent metallic mold within which the inside surface of the metal mold is coated with a thin coating of refractory materials and other processing fillers and/or additives. As a result of the limited insulating contribution of this coating, the high solidification rate of the surface of the centrifugal casting results in undesirable microstructures near the surface of the casting. Because the heat extraction rates are less severe from the inside to the outside of the solidifying casting, there will be a non-uniform microstructure of the iron from the outside to the inside of the casting. The depth to which the undesirable microstructure extends into the casting is a result of a variety of processing factors. This undesirable microstructure extending in from the surface of the casting can be very difficult to machine and will not exhibit the desired long wearing properties of the cylinder liner's bore surface for the operation of an engine. In addition, the coating material that is introduced into the spinning centrifugal mold becomes attached or embedded into the outside surface of the centrifugal casting. These impurities must then be removed from the outside of the centrifugal casting in a separate operation. In some cases such impurities can become sufficiently imbedded in the surface of the casting to cause the casting to be scrapped out.

When cast iron cylinder liners are used in aluminum block engines the effect of the differences of the coefficient of thermal expansion (CTF) of the two materials needs to be considered. Because the CTE's are different, under certain applications there may be separation of the outside surface of the cylinder liner from the aluminum block during the operation of the engine. The extent that this separation occurs and the consequences of it depend upon the design and type of the engine. To prevent such separation, in some applications mechanical bonding is specified between the outside of the cylinder liner and the aluminum block. In other applications, mechanical bonding is not specified. Many cylinder liners are cast into aluminum blocks that have no mechanical bonding at all between the liner and the block. While there is no mechanical bonding, it is still desirable to provide a continuous encapsulation (adherence) of the aluminum around the liner. To accomplish this adherence, the surface of the cylinder liner is roughened by appropriate machining threads and even pitting the surface using a process, such as shot blasting. Shot blasting, while roughening the surface, does not create cavities that provide casting material back drafts for mechanical locking or bonding. Shot blasting is accomplished using shot, which are substantially spherical particles with no angles or sharp edges. The outside surface subject to shot peening reduces the surface tension of the molten casting material during casting, allowing it to flow smoothly and completely around the entire surface of the liner. Shot peening of non-mechanically bonded cast-in cylinder liners is often used in applications such as water-cooled aluminum block engines, where mechanical bonding between the liner and block is typically not required.

However, in some applications utilizing cast iron cylinder liners in aluminum block engines, it is desirable or required to have mechanical bonding of the cast iron liner to the aluminum block. Such applications may include air-cooled aluminum block engines, as well as certain water-cooled aluminum block engines. Mechanical bonding is desirable for a number of reasons. For example, under certain conditions, such as extreme thermal cycling, a non-mechanically bonded liner may separate from the aluminum block because of the different CTE's of the two materials. A mechanical bond between the outside of the liner and the host aluminum block helps to ensure good thermal conductivity between the two materials and the bond can also add to the stability of the roundness of the liner in operation.

Two common approaches to accomplishing such mechanical bonding have been utilized with cast-in cast iron liners in aluminum block engines. One approach for static cast liners, as disclosed in U.S. Pat. No. 3,561,104 (the "'104 patent"), which is herein incorporated by reference in its entirety, involves casting vertical ribs on the outside which are subsequently peened over using centerless grinding during subsequent machining to provide a back draft condition and a resultant mechanical bond when cast into an aluminum block. Another technique used for centrifugally cast liners, as disclosed in U.S. Pat. No. 6,468,673 (the "'673 patent"), which is herein incorporated by reference in its entirety, involves casting in a manner to form a very rough exterior on the outside diameter of the centrifugal liner by utilizing an appropriate refractory coating on the inside of the spinning centrifugal mold. The rough as-cast exterior surface of the liner provides spines, mushrooms and crevices on the outside of the liner that provide a back draft condition and a mechanical bond when cast into an aluminum block.

While both the methods of the '104 patent and the '673 patent provide mechanical bonding between the cylinder liner and the aluminum block, they have some drawbacks. First, they both involve an as-cast outside diameter surface of the cylinder liner. The use of an as-cast surface brings with it the problems associated with cast iron microstructures near the surface of the casting. The surface of gray iron castings may include undesirable microstructures formed in the iron because of the faster solidification rates close to the surface of the casting. The surface effects, which are more pronounced in centrifugal casting compared to static casting, can extend well into the cross-section of the cylinder liner. If a thin wall cylinder liner is desired to be used with an as-cast outside diameter, such undesirable microstructure resulting from the surface effect may actually extend through the liner cross-section to the inside diameter wear surface of the very thin liner. The extension of the undesirable microstructure through the liner cross-section may result in both manufacturability problems and/or functional problems for the liner.

Another problem with the above-discussed methods includes the removal of the residual material from the outside of the liners. In centrifugal castings, the residual material is a refractory coating material, which had been sprayed onto the inside surface of the spinning centrifugal mold. In such centrifugal liners, the back drafted crevices formed by the mold coating process may actually trap the refractory coating material in the surface of the liner. In static casting, such as the '104 patent, there may be imbedded or loose sand grains in the vertical as-cast ribs on the outside diameter of the liner. Such residual impurities prevent the intimate contact between the iron and the aluminum, which is the purpose of the mechanical bonding. In addition, the capability of controlling dimensional tolerances on an as-cast surface (centrifugal or static cast liner) is limited due to casting variables. As-cast tolerances may not be tight enough to allow a minimum distance between multiple cylinder liners in a block and to provide the optimum uniformity of wall thickness.

What is needed is a cylinder liner and a method for making a cylinder liner that provides mechanical bonding with the engine block with clean and close toleranced surfaces, while maintaining substantially uniform and desired microstructure across the entire cross section of the cylinder liner. The current invention provides solutions to these problems that are associated with the use of cylinder liners with as-cast outside diameter surfaces.

SUMMARY OF THE INVENTION

The present invention includes a method for making cylinder liners and cast engine blocks having cylinder liners having a strong mechanical bond with the engine block. The method includes providing a cast metallic cylinder liner having an outer surface of the cylinder liner. In a preferred embodiment, the surface of the cylinder liner is machined to remove surface effects or defects present from the casting process. Grit particles are directed at the outer surface of the cylinder liner with a grit-blasting device at a predetermined angle of contact at a sufficient velocity to form cavities on the outer surface. The cavities that are formed have a geometry capable of forming a mechanical bond with the casting material of the engine.

The present invention also includes a cylinder liner having a substantially uniform microstructure having an machined outer surface and a plurality of irregular cavities formed in the machined outer surface. The cavities on the surface of the cylinder liner facilitate formation of mechanical bond when the cylinder liner is contacted with a molten material.

The present invention also includes a cast engine block having a cylinder liner cast-in, that is, the engine block is cast around the cylinder liner. The cylinder liner has a substantially uniform microstructure, and an outer surface having a plurality of irregular cavities. The cavities form a mechanical bond with the casting material making up the engine block on casting.

In another one embodiment of the present invention, a cast iron cylinder liner is machined on the outside diameter to remove any microstructural surface effects and then is uniformly grit blasted to provide microscopic voids and cavities on the surface of the liner which are filled with molten casting material, such as aluminum, when the liner is cast into an engine aluminum block or compressor housing, resulting in a mechanical bond between the cast iron liner and the solidified aluminum.

An advantage to the process of the present invention includes a strong mechanical bonding at the surface on the outside of the liner with the engine block, providing bore stability in a cast engine, which can improve oil consumption and reduce emissions.

Another advantage of the present invention is that the process provides a suitable mechanical bonding surface on a liner with no undesirable microstructural surface effects. In particular, the process permits machining prior to grit blasting, wherein the machining may remove undesirable surface effects and/or surface defects. The substantial absence of deleterious microstructural surface effects permit easy machining of the inner diameter and/or easy machining of engine components, such as cylinder ports.

Still another advantage of the present invention is that the process provides a mechanical bonding surface clean and substantially void of any refractory or sand residue from the cylinder liner casting process.

Still another advantage of the present invention is that the process provides a mechanical bonding surface with machined tolerances that are tighter than as-cast tolerances.

Still another advantage of the present invention is that machining the outer diameter prior to grit blasting allows for the salvaging of cylinder liner castings that may have defects present on the as-cast surface of the liner castings.

Still another advantage of the present invention is the machining process that may be used on the outer diameter surface may include machining process that do not utilize chemical or lubricant contact, which may provide machined surfaces having little or no contamination.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The subject matter under consideration is a cylinder liner having a grit blasted exterior surface of the cylinder liner to form a rough surface exterior on the liner for the purpose of providing a firm bond between the cast iron cylinder liner and a block made up of a casting material, such as aluminum, into which the liner is cast. The bond between the roughened cylinder liner surface and the block cast around the liner preferably takes the form of a mechanical bond, with the cast aluminum material being trapped within the cavities of the rough exterior of the grit blasted iron liner.

The process involves machining the outside surface of the cylinder liner to remove any undesirable microstructural surface effects. The liner with the machined outside diameter is then uniformly grit blasted over a preselected portion of the outside surface, that is, the entire outside surface or a specific portion of the surface to provide small voids and/or cavities that serve as backdrafts for subsequent mechanical bonding with the aluminum block that is cast around it. Backdrafts, as used herein, are areas or cavities into which molten casting material may enter and/or is drawn, wherein at least one surface of the area is at an angle to the surface of the cylinder liner that provides mechanical interlocking sufficient to form a mechanical bond.

The present invention preferably includes grit blasting static cast cylinder liners that have been machined to remove any surface effects and/or defects. Static casting, often referred to as conventional sand casting, involves an expendable blend mold typically formed from mold segments and an optional mold core or other apparatus that forms the interior surface of the cylinder liner. The use of the static casting process with its insulating molding material on the inside and outside surfaces of the castings assist in providing a cylinder liner having a substantially uniform microstructure.

Although the static cast cylinder liner is preferred, the present invention may also be utilized on centrifugally cast or cylinder liners manufactured using other known methods, wherein undesirable microstructure surface effects may be present.

Figure 1:
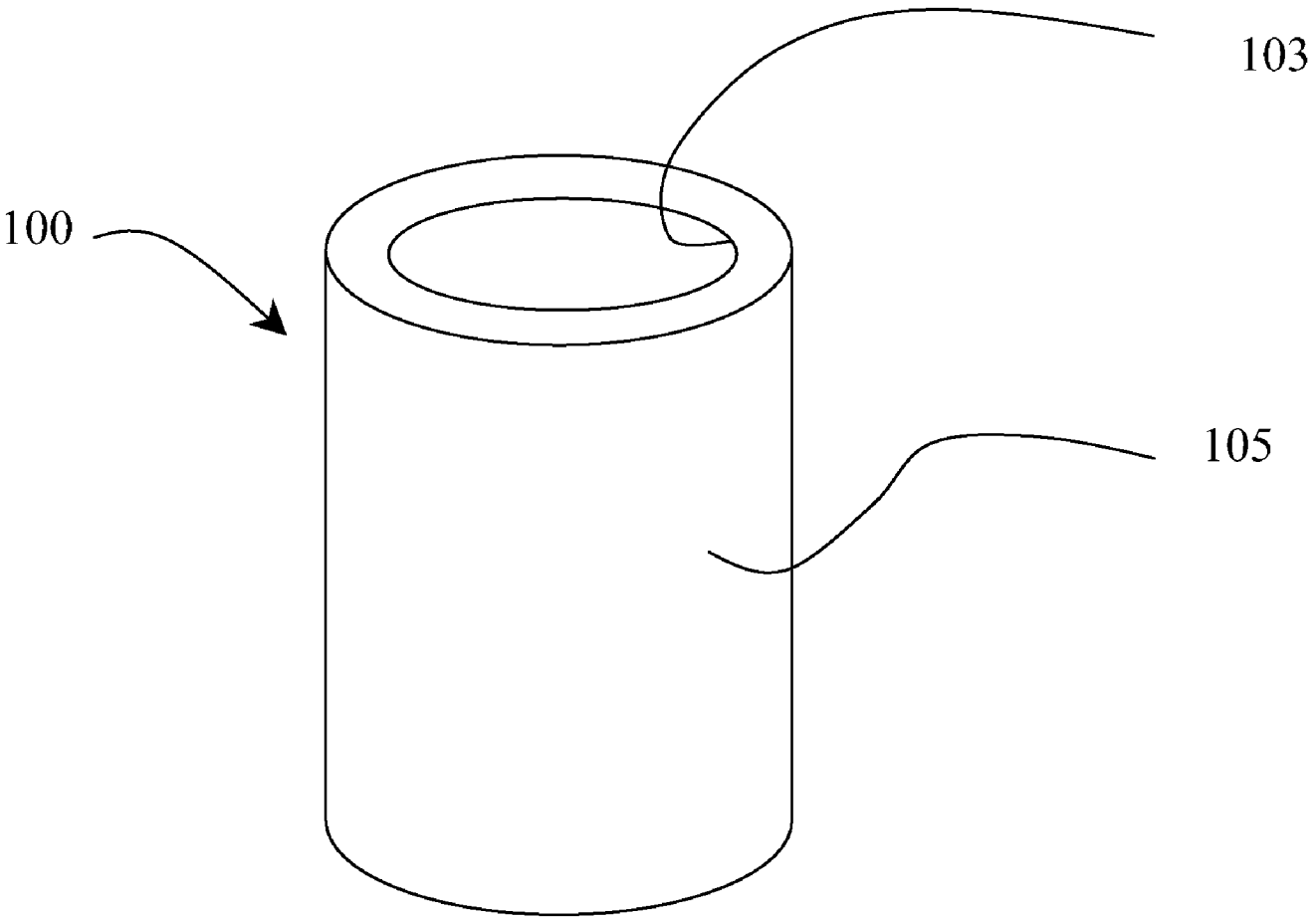
FIG. 1 shows a perspective view of a cylinder liner according to the present invention.

FIG. 1 shows a cylinder liner 100 according to the present invention. The cylinder liner 100 includes an inner surface 103 and an outer surface 105, forming a cylinder. The outer surface 105 is a surface suitable for contacting casting material during a cast-in process. The outer surface 105 is preferably machined to remove any surface effects from the casting process and/or remove any surface defects. The machining may take place using any known machining process suitable for use on the outer diameter surface of cylinder liners. A preferred machining process includes dry machining of the surface, wherein the machining takes without the use of chemicals or lubricant compositions. Dry machining provides surfaces that have little or no contamination.

Figure 2:
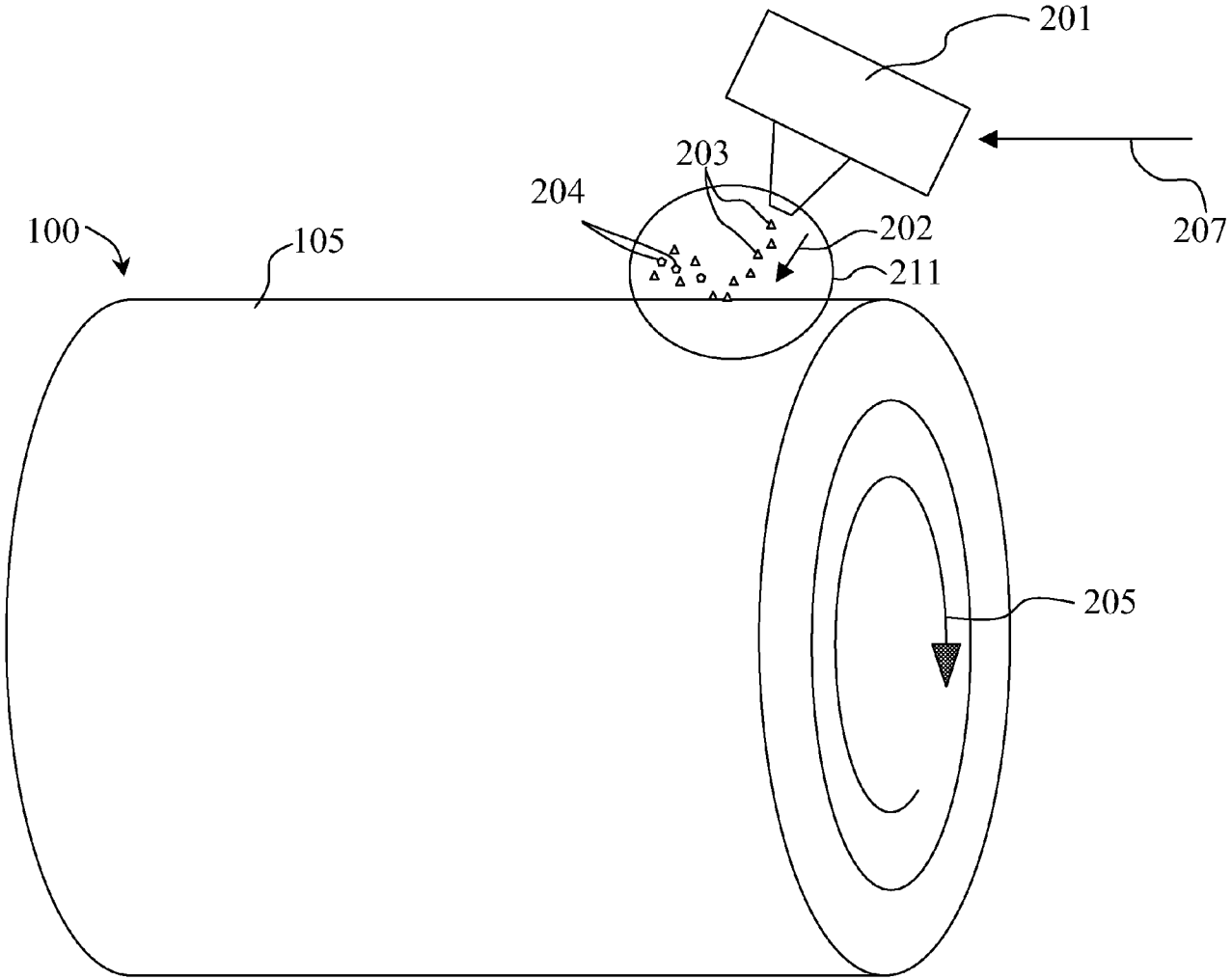
FIG. 2 shows a treatment process and apparatus according to the present invention.

FIG. 2 shows a cylinder liner 100 being subject to grit blasting according to an embodiment of the invention. A grit-blasting device 201 is arranged and disposed to direct grit particles 203 toward outer surface 105 of the cylinder liner 100 in direction 202. The grit particles 203 suitable for use with the present invention include a size, shape and density that, when forcefully contacted with the cylinder liner outer surface 105, form cavities 301 on the surface of the cylinder liner. In addition, the grit blasting device 201 utilized to accelerate the grit particles 203 provides grit velocities and angles to the cylinder liner surface that provide cavities 301 on the surface having desired geometry. The grit blasting process of the present invention includes directing abrasive grit particles 203 accelerated by compressed air or other media or mechanically thrown against a surface. The high-speed particles remove material from the surface, roughening the surface and form cavities 301. Grit useful for the present invention includes, but is not limited to steel grit, aluminum oxide, silicon carbide, garnet, crushed ceramic material and combinations thereof. Unlike shot, grit has a geometry including sharp angles that are capable of ejecting material present on the surface of the cylinder liner 100. While the geometry is not specifically limited, the grit particles 203 should have a geometry with sufficiently sharp angles to provide the surface with cavities having the desired geometry. Grit suitable for use with the present invention preferably has a size of about 0.125 to about 2.8 mm. A preferred grit particle 203 size is from about 1.70 mm to about 2.36 mm. Likewise, the grit particles from about 6 Moh to about 9 Moh, preferably has a hardness of from about 8 Moh to about 9 Moh. In a preferred embodiment of the present invention, the grit is steel grit, corresponding to SAE Standard G12, wherein the SAE Standard is the standard set forth by the Society of Automotive Engineers in document number J444, dated July 2005.

In another embodiment of the present invention, mixtures of sizes and/or types of grit particles 203 may be used to produce desired cavity 301 geometries. The cylinder liner 100 is rotated in a direction 205 at a speed sufficiently slow to provide sufficient grit particle concentration to form the desired cavities on outer surface 105, and sufficiently fast to prevent or eliminate erosion of cavities previously formed. Likewise, the grit blasting device 201 may be advanced along the surface of the cylinder liner 100 in direction 207 to expose additional surfaces to the grit particles 203 directed from the grit blasting device 201. As shown, the grit particle 203 contact outer surface 105 and eject cylinder liner material 204.

Figure 3:
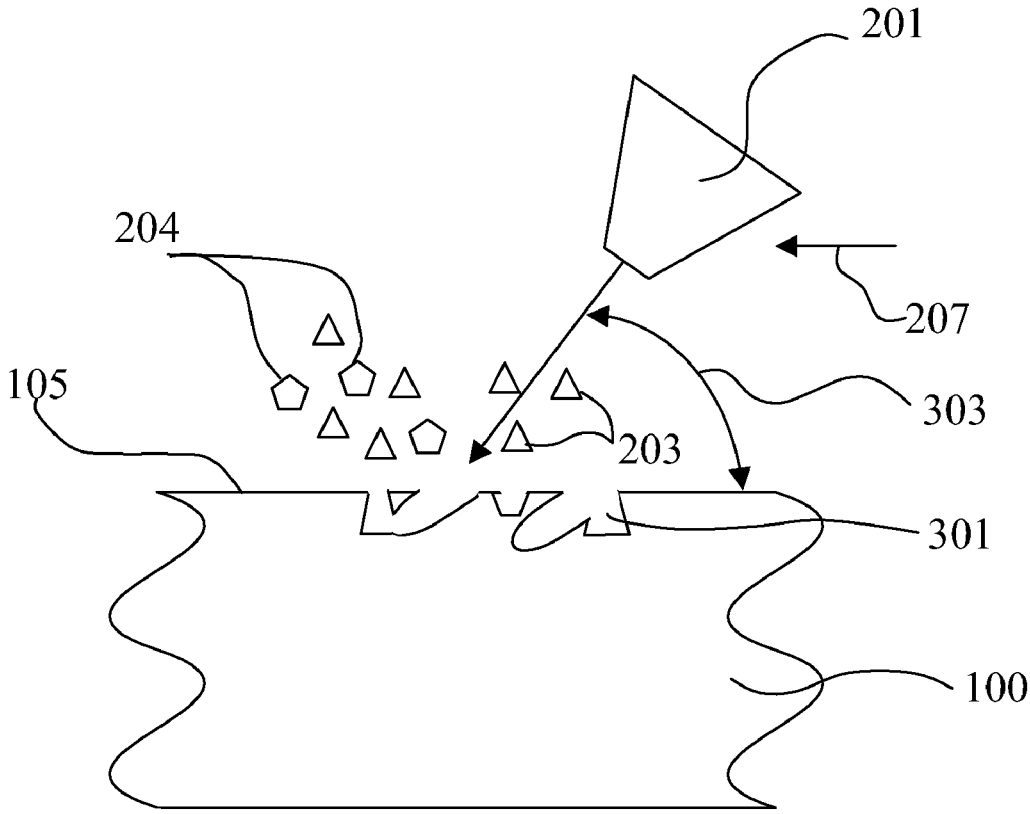
FIG. 3 shows an exploded view of the surface of a cylinder liner during a process according to the present invention.

FIG. 3 shows an exploded view from area 211 of FIG. 2. As shown, the grit particles 203 are directed from the grit-blasting device 201 at a predetermined contact angle 303 to the cylinder liner outer surface 105. Once the grit particles 203 contact the surface, at least a portion of the material at the surface is ejected as ejected particles 204. Cavities 301 are exposed as from the locations formally occupied by the material of the ejected particles. The contact angle 303 is an angle that provides cavity 301 formation by producing ejected particles 204, and allows the grit particles 203 to deflect off the outer surface 105 for potential collection and reuse. Contact angle 303 is preferably from about 55° to about 85°. In a preferred embodiment of the invention, the contact angle 303 is about 70°. The cavities 301 formed on the cylinder liner outer surface 105 provide spaces into which molten casting material may enter and solidify. In addition to the velocity of the particles and the contact angle 303, the grit-blasting device 201 is configured to provide a contact time that reduces or eliminates the erosion of formed cavities 301. The contact time is preferably limited by moving either or both of the cylinder liner 100 or the grit blasting device 201 with respect to each other in a manner that provides controlled grit particle 203 concentration on areas of the surface requiring cavity formation. Likewise, the movement of the cylinder liner 100 or the grit-blasting device 201 is such that the overlap in areas in which cavities are formed is minimized to prevent or eliminate erosion of cavities 301 previously formed.

The process of the present invention modifies the outer surface 105 of a cylinder liner 100 in a controlled manner so that the surface has a specific, controlled geometry that results in small back drafted cavities 301 peppered on the outer surface 105 of the liner. The cavities 301 formed, according to the present invention, have a geometry that includes surfaces within the cavities that are non-perpendicular to the surface of the cylinder liner 100. Specifically, the cavities specifically have side surfaces that are angular (more or less than 90°) with the outer surface 105 of the liner (i.e., the surfaces are undercut). These cavities 301 are subsequently filled with molten casting material during casting of the block and provide mechanical bonding between the block material and the cylinder liner 100. The non-perpendicular surface of the cavities 301 provides a surface onto which a mechanical bond between the cylinder liner 100 and the casting material may be formed. Specifically, the cavities 301, including the non-perpendicular surfaces, provide a surface of the cylinder liner 100 which interlocks the material of the cylinder liner and the casting material, wherein forces may be transferred from the casting material to the non-perpendicular surfaces of the liner, creating an adherent bond.

In another embodiment of the invention, a preselected portion of outer surface 105 that is grit blasted only partially covers the outer diameter of the liner with a roughened surface. This embodiment provides bonding at the preselected portions of the liner wherein bonding with aluminum are most important to provide the necessary bond, while minimizing the time cycle and cost of grit blasting.

The use of a grit blasting process to roughen the surface permits the surface to be machined to have a metallurgical microstructure that is substantially uniform across the surface and through the thickness. This uniformity is not achievable in other process, such as centrifugal casting, wherein the castings are typically utilized as-cast. Likewise, static cast liners are likewise typically cast into engine blocks in their as-cast form. The uniformity from the machining prior to grit blasting, among other things, permits the liner to have a reduced thickness as compared to liners with as-cast surfaces, is more easily machined due to its uniform desired microstructure compared to liners with as-cast surfaces and provides a consistently more desirable metallurgical structure at the wear surface of the cylinder liner in operation of the engine. Further, the machining permits a reduction in the number of defective parts. For example, if a centrifugal or static cast liner formed by a known has been rejected due to undesirable grain structure at the surface or a surface defect, the process of the present invention may be utilized to machine the undesirable grain structure at the surface or a surface defect away and grit blast the surface to provide a surface that provides a strong mechanical bond when cast in the aluminum block.

During a cast-in-place process, the cylinder liner is positioned in a mold. A molten metallic material is injected into the mold and permitted to solidify. The molten material preferably has a melting temperature less than the melting temperature of the cast iron. The grit blasted surface includes pores into which the metallic material enters and solidifies. The molten metal may infiltrate the cavities 301 by any suitable means, including, but not limited to, simple mass flow, capillary action, wicking or any other molten casting material flow mechanism.

Figure 4:
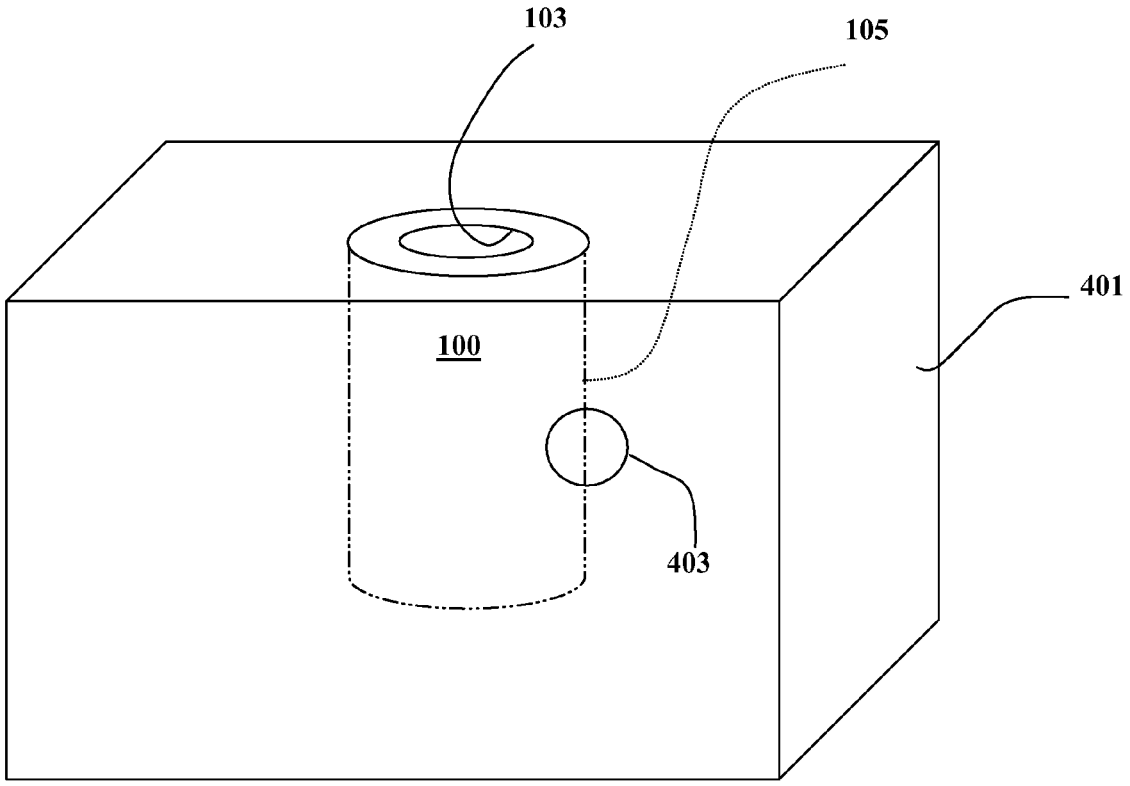
FIG. 4 schematically shows a cylinder liner according to the present invention cast into an engine block.

FIG. 4 shows a cylinder liner 100 that has been cast-in an engine block 401. As discussed above, the molten metallic casting material, preferably aluminum or aluminum alloy, is injected into the mold and permitted to solidify. Casting material infiltrates the cavities 301 of the cylinder liner surface 105 and forms a mechanical bond.

Figure 5:
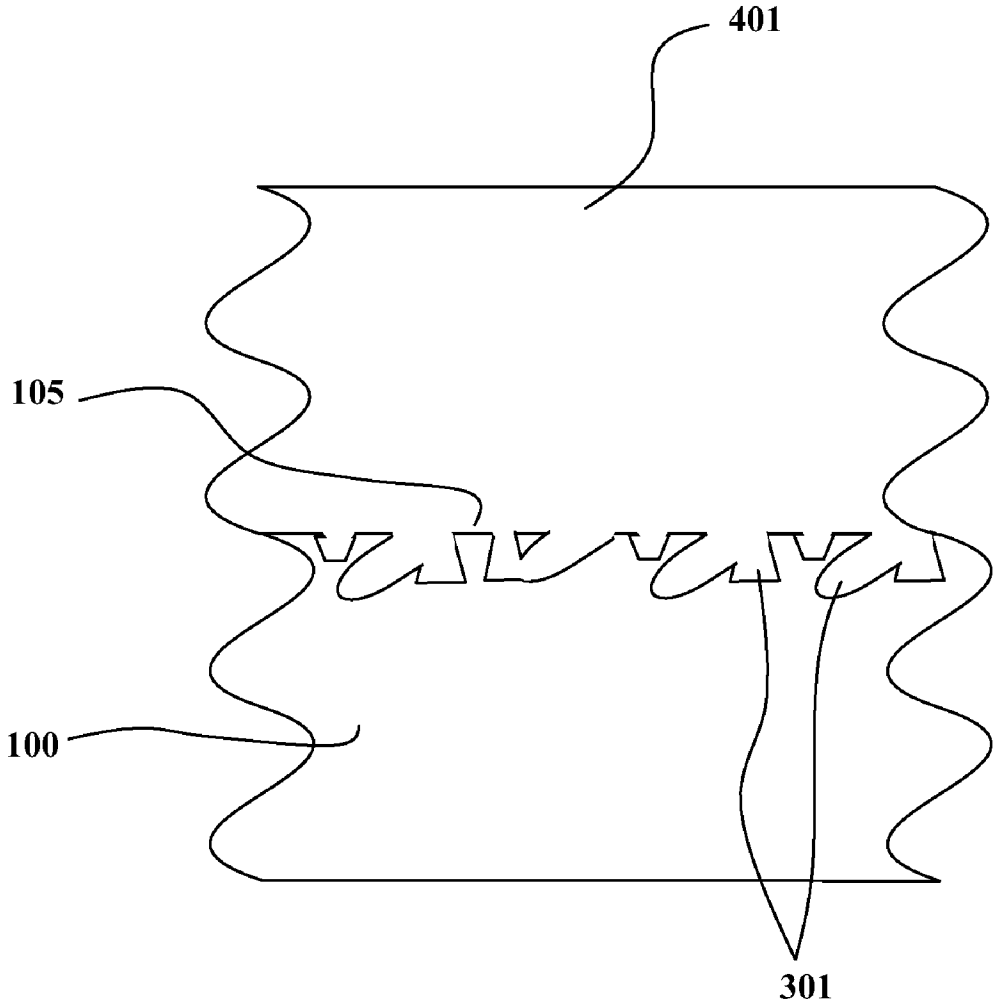
FIG. 5 shows an exploded view of a surface of the cylinder liner according to the present invention when cast into the engine block.

FIG. 5 shows an exploded view of area 403 of FIG. 4. As shown, the solidified casting material is present in cavities 301, wherein the cavities 301 have a geometry that provides an adhesive force, resulting from, among other factors, to the non-perpendicular surfaces of the cavities 301, which do not permit disengagement of the engine block 401. The cylinder liner 100 is adhered to the engine block 401 via a strong mechanical bond. While not wishing to be bound by theory, it is believed that the primary bond is mechanical, wherein metallurgical bonds between the roughened cast iron surface and the cast-in aluminum may be present.

Figure 6:
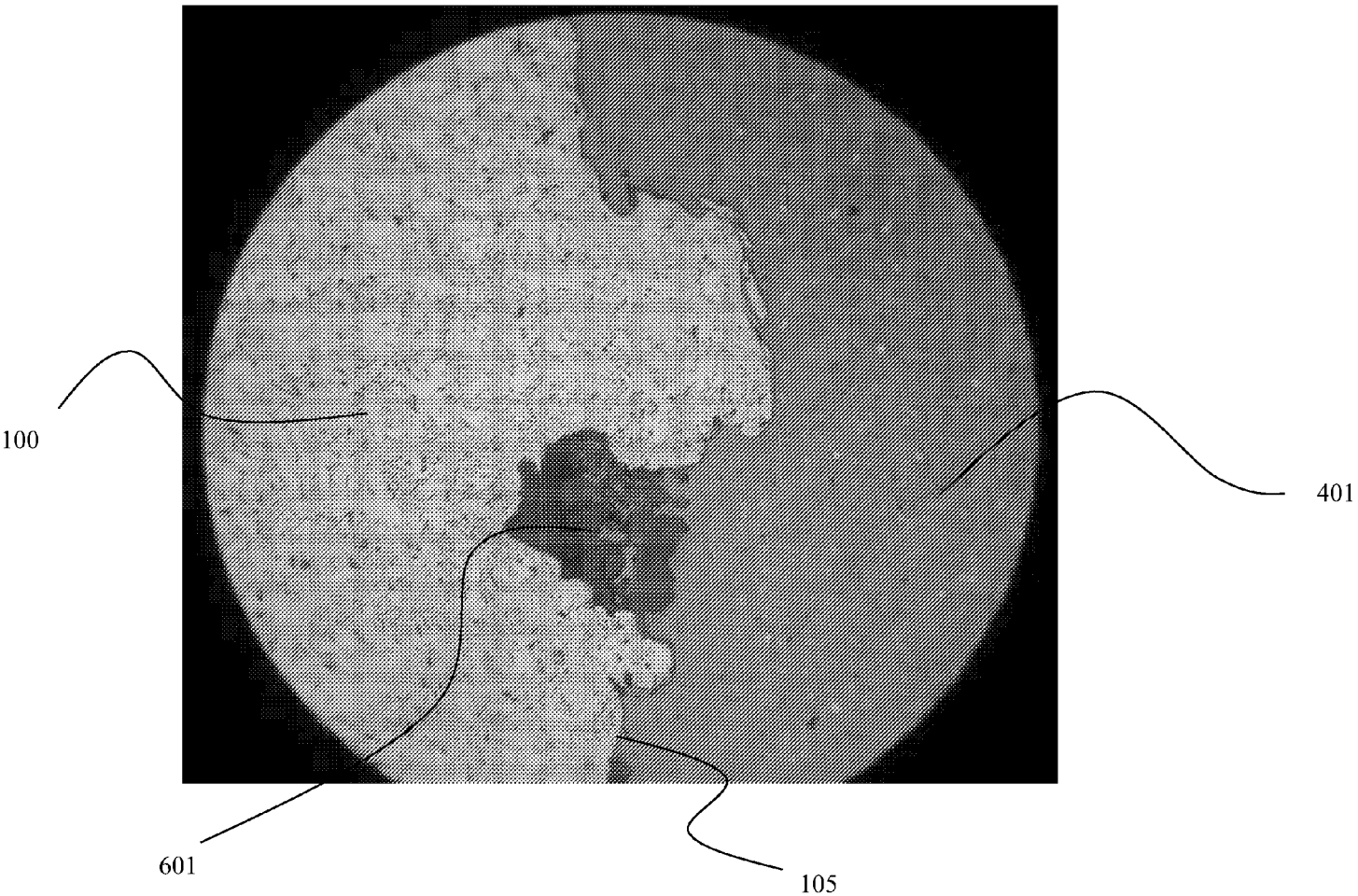
FIG. 6 (PRIOR ART)
FIG. 6 shows a photomicrograph of a surface at 100 times magnification of a centrifugal cylinder liner cast-in an aluminum block utilizing prior art

FIG. 6 shows photomicrograph of a surface 105 of a cylinder liner 100 cast into an aluminum block 401 at 100 times magnification according to a process known in the art. This is an example of an as-cast outside bonding surface of a centrifugal liner cast into an aluminum block. This photomicrographs illustrates the presence of residual refractory coating material 601 embedded in the outside surface of the cylinder liner preventing intimate contact between the iron and the aluminum. The photomicrograph in FIG. 6 also illustrates the presence of undesirable microstructures near the surface of the as-cast bonding surface of the cylinder liner.

Figure 7:
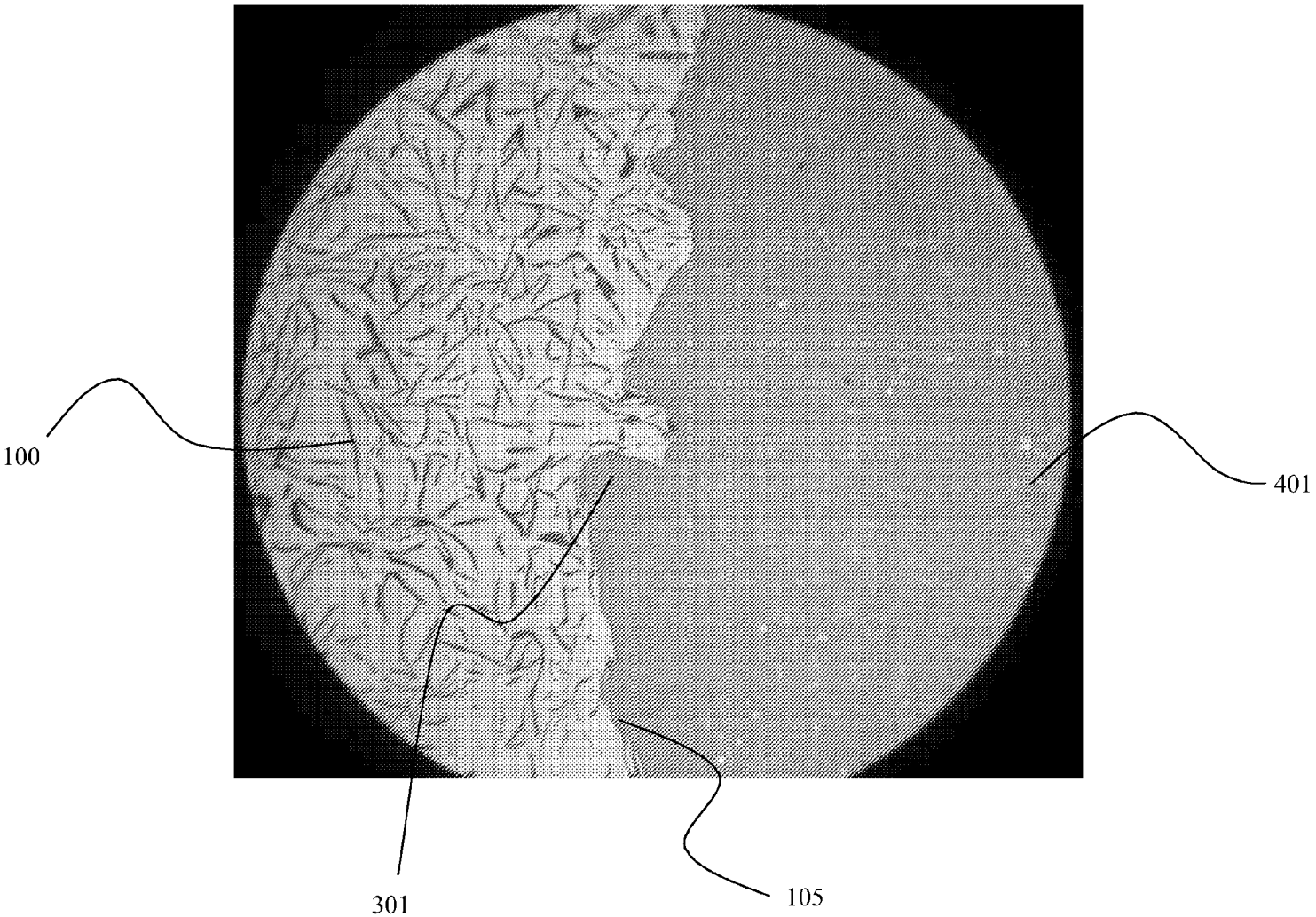
FIG. 7 shows a photomicrograph of a surface at 100 times magnification of a cylinder liner according an embodiment of the present invention cast-in an aluminum block.
Figure 8:
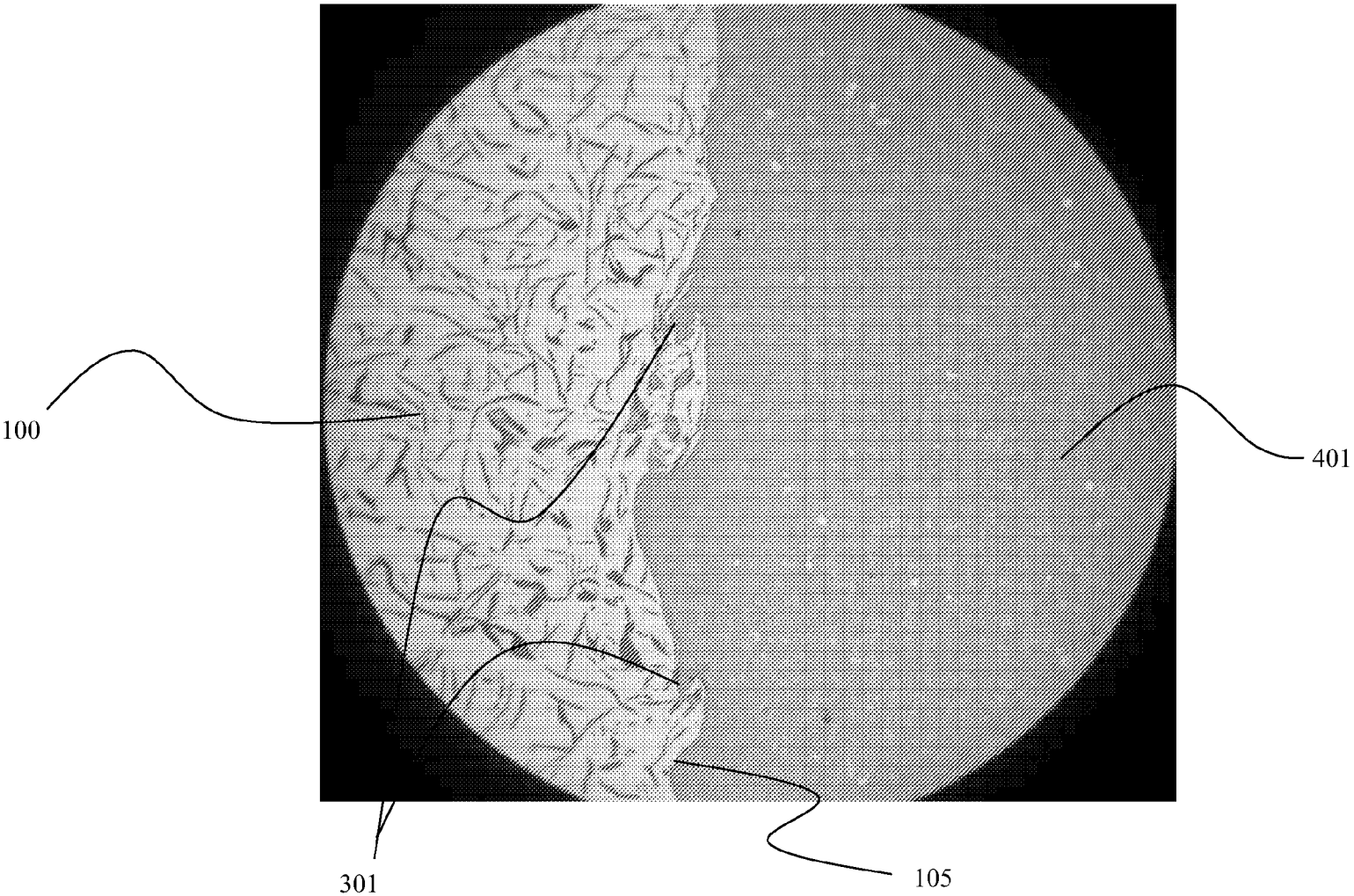
FIG. 8 shows another photomicrograph of a surface at 100 times magnification of a cylinder liner according an embodiment of the present invention cast-in an aluminum block.
Figure 9:
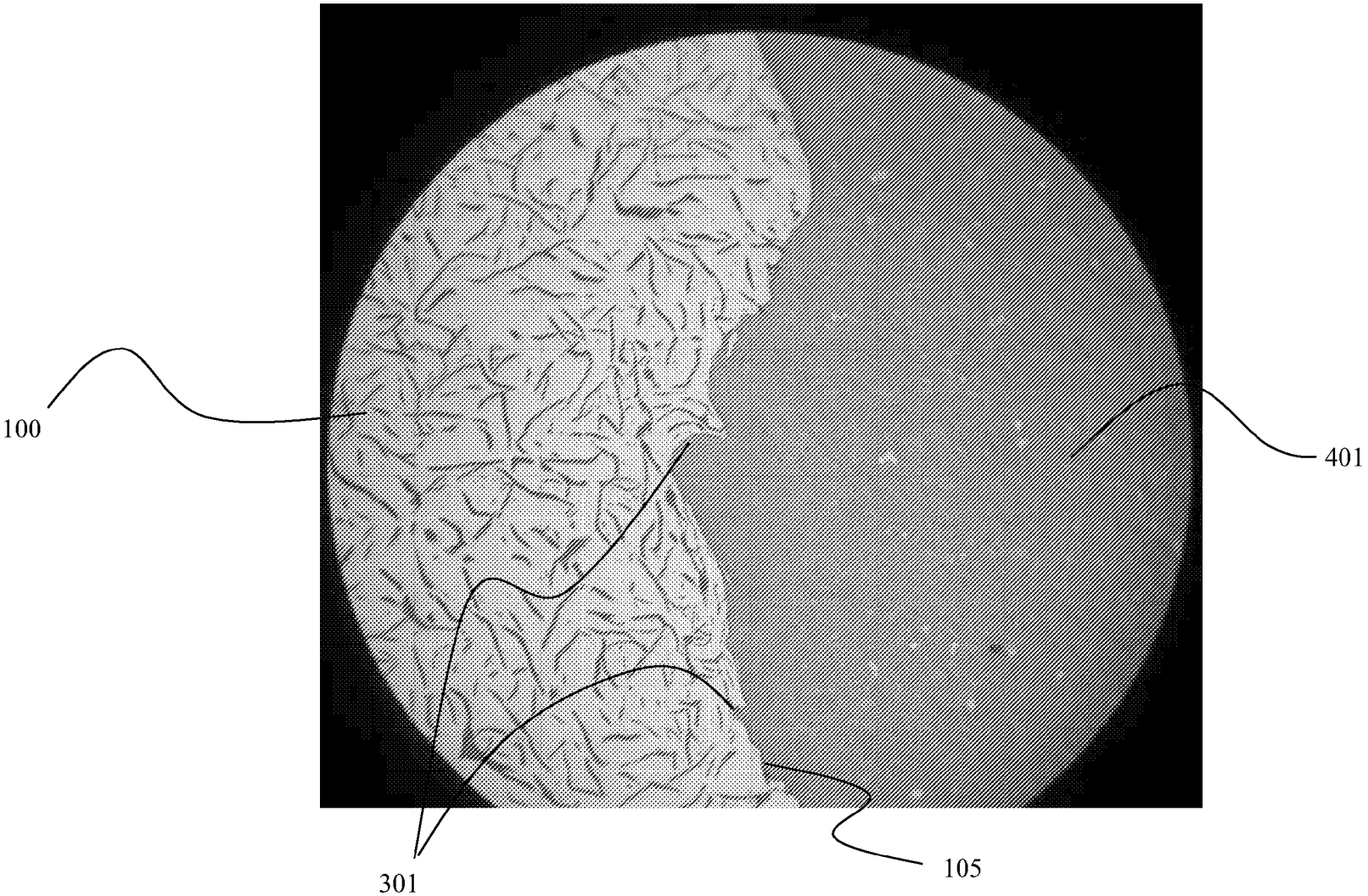
FIG. 9 shows still another photomicrograph of a surface at 100 times magnification of a cylinder liner according an alternate embodiment of the present invention cast-in an aluminum block.
Figure 10:
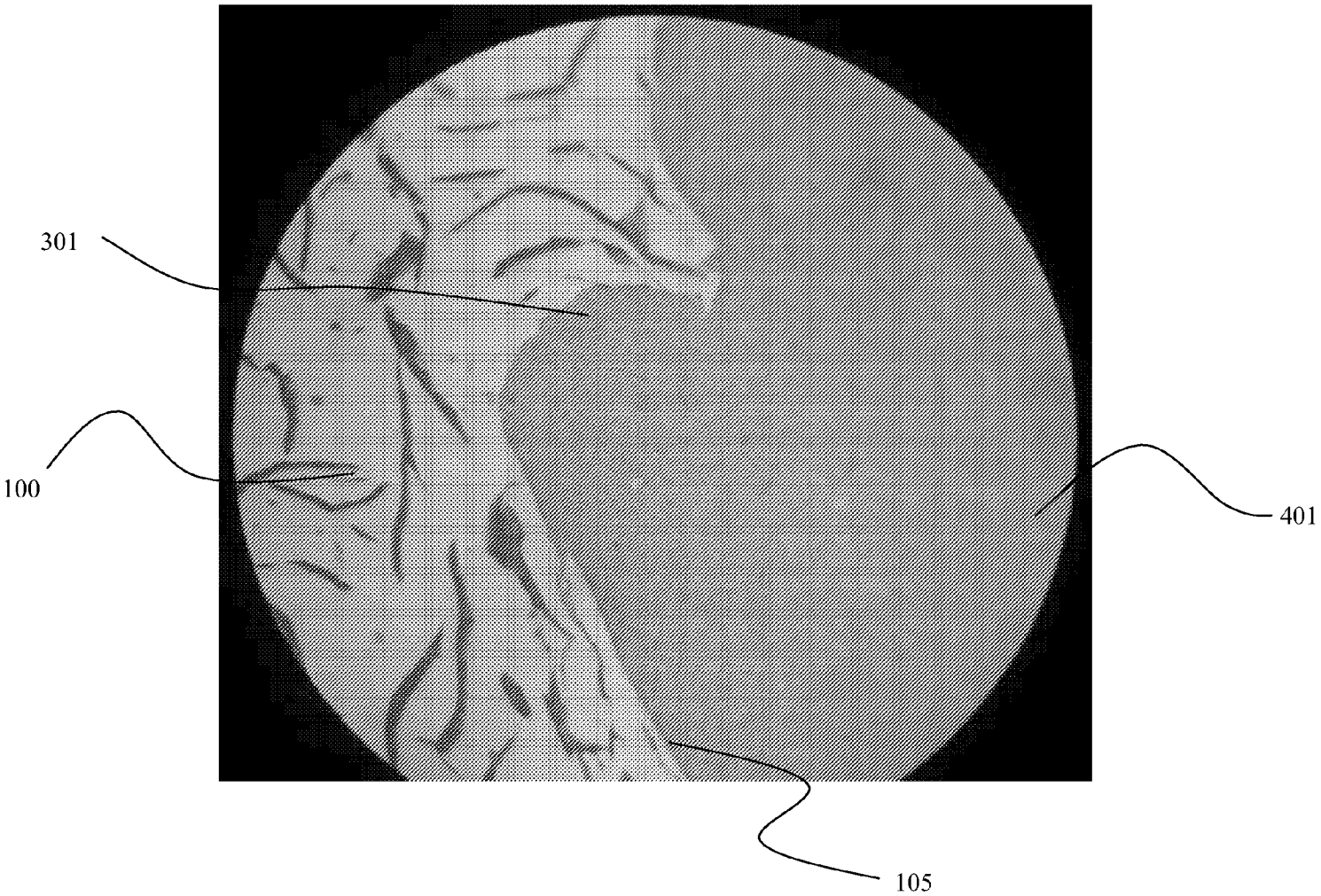
FIG. 10 shows a photomicrograph of the surface of FIG. 9 at 400 times magnification.

FIG. 7 shows a photomicrograph of the surface of a cylinder liner 100 at 100 times magnification according to an embodiment of the present invention. FIG. 8 shows another photomicrograph of the surface of a cylinder liner 100 at 100 times magnification according to an embodiment of the present invention. FIG. 9 shows a photomicrograph of the surface of a cylinder liner 100 at 100 times magnification according to an embodiment of the present invention. FIG. 10 shows a photomicrograph of the surface of a cylinder liner 100 shown in FIG. 9 at 400 times magnification. The as-cast cylinder liner 100, as seen in each of the photomicrographs shown in FIGS. 7-10, has a machined surface that is subsequently grit blasted to form cavities 301 and is placed into an engine block mold, wherein an aluminum containing casting material is provided to the mold and allowed to solidify. As seen in the photomicrographs, the surface 105 of the cylinder liner has cavities 301 into which the casting material of the aluminum block 401 may flow into to form a mechanical bond. These photomicrograph illustrates the clean surface of the cylinder liner providing intimate contact between the cast iron and the aluminum. These photomicrographs also illustrate the presence of desirable microstructure of the cast iron at the bonding surface of the cylinder liner using the present invention.

EXAMPLE

A cylinder liner according to the present invention was prepared. A cast iron cylinder liner 4.0 inches long and having an outer diameter of 3.5 inches was machined to provide an outer diameter substantially free of surface effects. A grit size G12 was delivered at an angle of 70° with compressed air delivery of 90 psi through a 0.25" nozzle located 9.0" away from the surface of the liner. The cylinder liner was rotated at about 60 RPM as the grit was sprayed uniformly along the surface of the liner. The process was continued for about 30 seconds to cover the outer diameter surface of the liner. The cylinder liner 100 produced included cavities peppered along the surface of the outer diameter.

While the above has been described with respect to cylinder liners 100 and engine blocks 401, the process of the present invention may also find use with cast-in articles requiring strong mechanical bonds and substantially uniform composition and microstructure in the cast-in article.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method comprising:

providing a cast iron alloy cylinder liner having an outer surface of the cylinder liner;

machining the outer surface of the cylinder liner to remove surface defects or surface effects;

directing grit particles at the outer surface at a predetermined angle of contact at a sufficient velocity to form cavities on the outer surface; and forming the cavities, wherein the cavities formed have a geometry capable of forming a mechanical bond with a casting material;

wherein the cylinder liner having the cavities formed thereon has a substantially uniform microstructure throughout the thickness of the cylinder liner.

2. The method of claim 1, wherein the geometry of the cavities comprises a surface disposed at an angle to the outer surface that is non-perpendicular.

3. The method of claim 1, wherein the grit particles are directed by a pneumatic device accelerating the grit particles using an air medium.

4. The method of claim 1, wherein the grit particles are directed by a mechanical device accelerating the grit particles by mechanically throwing the grit particles.

5. The method of claim 1, wherein the grit particles are steel grit or aluminum oxide.

6. The method of claim 1, wherein the cylinder liner is a static cast cylinder liner.

7. The method of claim 1, wherein the cylinder liner is a centrifugal cast cylinder liner.

8. The method of claim 1, further comprising contacting the surface of the cylinder liner with a molten casting material and solidifying the casting material to form an engine block having a lined cylinder, the molten casting material having a melting temperature less than the melting temperature of the cylinder liner.

9. The method of claim 8, wherein the casting material comprises aluminum or an alloy of aluminum.

10. A cast iron cylinder liner having a substantially uniform microstructure comprising:

a machined outer surface; and a plurality of irregular cavities formed in the machined outer surface wherein the cavities facilitate formation of a mechanical bond when contacted with molten material;

wherein the substantial uniform microstructure is throughout the thickness of the cylinder liner, and wherein the cylinder liner is a cast iron alloy.

11. The cylinder liner of claim 10, wherein the cylinder liner is a static cast liner.

12. The cylinder liner of claim 10, wherein the cylinder liner is a centrifugal cast liner.

13. The cylinder liner of claim 10, wherein the outer surface of the cylinder liner is substantially free of residual molding or coating material from casting of the cylinder liner.

14. A cast engine block comprising:

cylinder liner having a substantially uniform microstructure, the cylinder liner having a first melting temperature further comprising:

a machined outer surface having a plurality of irregular cavities;

wherein the cavities form a mechanical bond with casting material comprising the engine block, the casting material comprising the block having a second melting temperature below the first melting temperature; and wherein the cylinder liner comprises a cast iron alloy.

15. The engine block of claim 14, wherein the cylinder liner is a static cast liner.

16. The engine block of claim 14, wherein the cylinder liner is a centrifugal cast liner.

17. The engine block of claim 14, wherein the outer surface of the cylinder liner is substantially free of residual molding or coating material from casting of the cylinder liner.

18. The engine block of claim 14, wherein the casting material comprises aluminum or an aluminum alloy.

* * * * *